US010322307B2

(12) United States Patent
Leigh

(10) Patent No.: US 10,322,307 B2
(45) Date of Patent: Jun. 18, 2019

(54) APPARATUS AND METHOD FOR FIREFIGHTING

(76) Inventor: Daniel Leigh, Jerusalem (IL)

( * ) Notice: Subject to any disclaimer, the term of this patent is extended or adjusted under 35 U.S.C. 154(b) by 623 days.

(21) Appl. No.: 13/884,965

(22) PCT Filed: Nov. 23, 2011

(86) PCT No.: PCT/IL2011/050028

§ 371 (c)(1),
(2), (4) Date: May 12, 2013

(87) PCT Pub. No.: WO2012/070050

PCT Pub. Date: May 31, 2012

(65) Prior Publication Data

US 2013/0220647 A1 Aug. 29, 2013

Related U.S. Application Data

(60) Provisional application No. 61/417,440, filed on Nov. 28, 2010.

(51) Int. Cl.
*A62C 2/04* (2006.01)
*A62C 3/02* (2006.01)
(Continued)

(52) U.S. Cl.
CPC ..... *A62C 2/04* (2013.01); *A62C 3/0228* (2013.01); *A62C 3/0278* (2013.01); *A62C 3/06* (2013.01);
(Continued)

(58) Field of Classification Search
CPC ..... A62C 2/04; A62C 99/009; A62C 3/0228; A62C 3/06; A62C 3/0278; A62C 99/0054; A62C 99/0063
(Continued)

(56) References Cited

U.S. PATENT DOCUMENTS 5,862,845 A 1/1999 Chin et al.
2007/0108170 A1 5/2007 Costin, Sr. et al.
(Continued)

FOREIGN PATENT DOCUMENTS

DE 25 54 631 A1 6/1977
JP 61-113470 A 5/1986
(Continued)

OTHER PUBLICATIONS

Michael D. Waterworth, Laser Ignition Device and Its Application to Forestry, Fire and Land Management, Apr. 27, 1987.*
(Continued)

*Primary Examiner* — Arthur O. Hall
*Assistant Examiner* — Qingzhang Zhou
(74) *Attorney, Agent, or Firm* — Chanoch Kahn; Simon Kahn

(57) ABSTRACT

A method of laser (30) based fire fighting, the method comprising: delivering energy from an emitted energy beam source to an active fire affected area (10) so as to process combustible material by one of cutting, ablating, charring and total oxidation so as to reduce the quantity of combustible material. Preferably the provided energy exhibits a total fluence of at least 50 micro-joule per square centimeter measured over a window of no more than 0.1 milliseconds. Preferably the provided energy is from a laser.

14 Claims, 4 Drawing Sheets

(51) Int. Cl.
*A62C 3/06* (2006.01)
*A62C 99/00* (2010.01)

(52) U.S. Cl.
CPC ..... *A62C 99/009* (2013.01); *A62C 99/0054* (2013.01); *A62C 99/0063* (2013.01)

(58) Field of Classification Search
USPC ..... 169/46, 91, 53, 52
See application file for complete search history.

(56) References Cited

U.S. PATENT DOCUMENTS

2009/0205845 A1* 8/2009 Hoffman ..... A62C 3/025 169/43
2010/0059236 A1 3/2010 Yee

FOREIGN PATENT DOCUMENTS

JP 2006-015130 A 1/2006
JP 200615130 * 1/2006 ..... A62C 39/00
WO 98/32495 A1 7/1998

OTHER PUBLICATIONS

International Search Report for PCT application PCT/IL2011/050028, Issued by the EPO, dated Aug. 2, 2012.
Written Opinion of the International Searching Agency for PCT application PCT/IL2011/050028, Issued by the EPO, dated Aug. 2, 2012.
Waterworth, Michael D. "Laser Ignition Device and its Application to Forestry, Fire and Land Management" Gen. Tech. Rep. (1987) pp. 182-186, Pacific Southwest Forest and Range Experiment Station, Forest Service, U. S. Department of Agriculture, PSW-101, Berkeley, CA.
Theberge F. et al. "Ultrafast Intense Laser 'Explosion' of Hardwood" Applied Surface Science (2002) 191: 328-333.
Hernandez, Juan Carlos et al. "High-power Yb-doped Fiber Laser for Cutting Dry Pine Wood" Proceedings of the World Congress on Engineering (2007) vol. II WCE 2007, Jul. 2-4, London, U.K.

* cited by examiner

APPARATUS AND METHOD FOR FIREFIGHTING

BACKGROUND OF THE INVENTION

The present invention relates to the field of firefighting, and in particular to extinguishing forest, bush, field, brush or chemical fires with an emitted energy beam.

For a fire to ignite and be sustained four elements need to be present, the elements classified in the "Fire Tetrahedron" as: heat, fuel, an oxidizing agent (usually oxygen) and a chemical reaction. Removing one of the four elements is sufficient to suppress a fire. Typical methods of extinguishing tree based fires are: spraying the fire with water, or other fire suppressing chemical; and removing fuel such as trees and foliage from the vicinity of the fire.

Water is very effective in extinguishing fire as it removes both the heat from the fire, as the water vapor absorbs heat, and the oxidizing agent, as the water vapor displaces the oxygen in the vicinity of the fire. Any of a plurality of chemicals are in use for fire extinguishing, the chemicals either: breaking up the chemical reaction in the fire, such as in the case of Halon; cooling the fire; or removing the oxygen from the fire. In some cases chemicals are sprayed on the area surrounding the fire, creating a firebreak, thereby slowing down the advancement of the fire and allowing more time for direct extinguishing of the fire.

Disadvantageously, large amounts of water and/or chemicals may be needed in the case of a forest fire. In many cases the water and chemicals need to be brought from a distance and over uncomfortable terrain, the large amounts needed making this a difficult and time consuming task, whereas time is of the essence in fire fighting. Furthermore, a large amount of people and vehicles may be needed for the task, adding a large expense. Additionally, there may be a limit to how much water and/or chemicals can be brought to a fire, especially in the case of inaccessible terrain, where aerial fire fighting is required.

Removing the surrounding grass, trees and foliage from the vicinity of the fire is effective as the fire reaches an area without any fuel, called a firebreak, and therefore extinguishes. However, removing the surrounding fuel can be time consuming and because of the unpredictable properties of the weather can end up being useless as the fire has reached the area before all the fuel has been removed, or has changed direction to a different area. Furthermore, removing surrounding trees and foliage adds a large expense.

Japanese Showa Patent Publication 61-113470 published in 1986 is addressed to a fire extinguishing method that utilizes an emitted energy beam which is directed at the combustible particles in a fire. In particular, an emitted energy beam is emitted towards combustible material comprising carbon causing the carbon electrons to move, thus making it impossible for the carbon atoms to combine with oxygen even in a high temperature environment. By doing so, the fire is obstructed from continuing and eventually dies out. Unfortunately, such a system does not appear to be functional, and is not found in the field.

Similarly Patent Abstracts of Japan Publication 2006-015130 is addressed to the use of a pulsed laser to extinguish a fire by providing a blast wave which breakdowns the fire. The blast wave is produced by ablating either air or material at some distance from the fire. Unfortunately, such a system does not appear to be functional, and is not found in the field.

An article by Michael D. Waterworth, presented at the Symposium on Wildland Fire 2000, in April 1987 suggested the use of a recently developed laser ignition device for controlled burning of forest logging slash. Such a device has not been adapted for active fire fighting.

SUMMARY OF THE INVENTION

Accordingly, it is a principal object of the present invention to overcome at least some of the disadvantages of prior art methods of firefighting. This is provided in certain embodiments by a method of firefighting, the method comprising: providing sufficient energy via an emitted energy beam to an active fire affected area so as to cut, ablate, char or ignite combustible material. In one embodiment the providing of sufficient energy via an emitted energy beam comprises: providing an emitted energy beam with a total fluence of at least 50 micro-joule per square centimeter when measured over a window of 0.1 milliseconds. Preferably, the total fluence is delivered in less than 30 nanoseconds, and further preferably in less than 30 picoseconds. In certain embodiments, such an emitted energy beam is utilized to rapidly extinguish a fire wherein the combustible material is in one of a liquid, gas or a solid state.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1A:
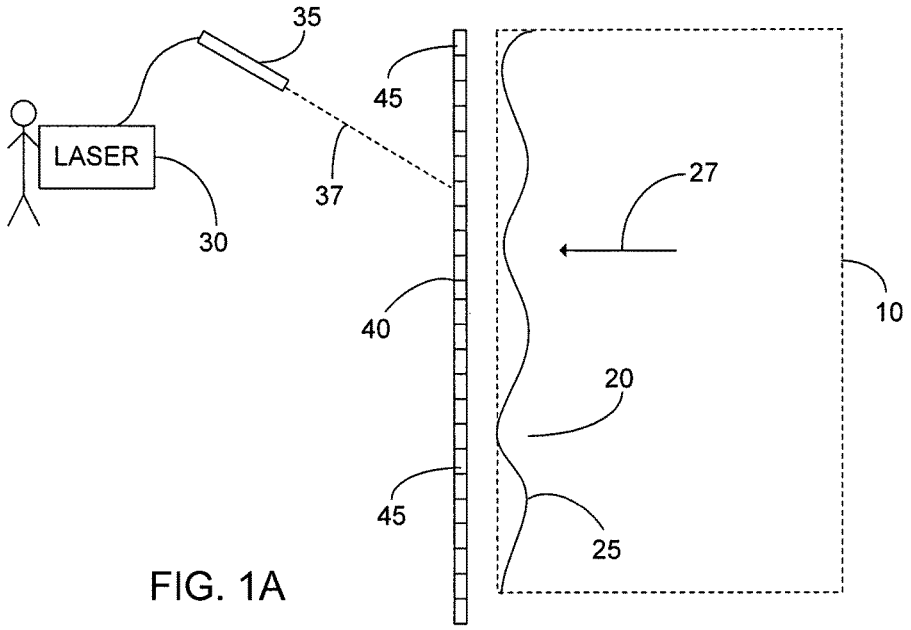
FIG. 1A illustrates a method of emitted energy beam based firefighting, comprising providing sufficient energy via an emitted energy beam to create a firebreak.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Figure 1B:
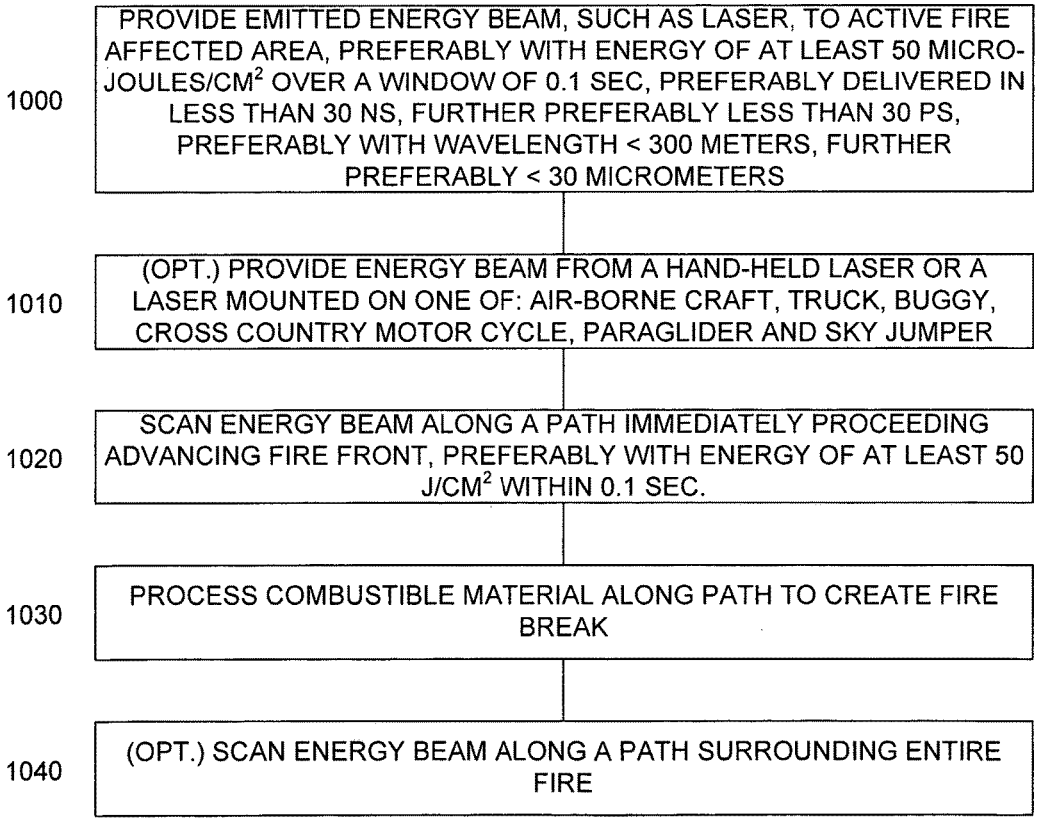
FIG. 1B illustrates a high level flow chart of the method of FIG. 1A.

FIG. 1A illustrates a method of emitted energy beam based firefighting, comprising providing sufficient energy via an emitted energy beam to create a firebreak and FIG. 1B illustrates a high level flow chart of the method of FIG. 1A, the figures being taken together. FIG. 1A is being described in relation to a laser, which is a particular example of an emitted energy beam, however this is not meant to be limiting in any way, and the use of a microwave energy beam, particle energy beam, electromagnetic energy beam, plasma beam, or directed induced high voltage electric discharge beam may be used without limitation. FIG. 1A illustrates an active fire affected area 10, presently affected by a fire 20 exhibiting a fire front 25; a laser 30, comprising an optical delivery system 35 focusing a beam 37; and a scan line 40, exhibiting a plurality of sections 45. Fire front 25 is described herein as the advancing front of fire 20 within active fire affected area 10, the advancing direction of fire front 25 depicted by arrow 27. Optical delivery system 35 is illustrated as being connected externally to laser 30, however this is not meant to be limiting in any way, and optical delivery system 35 can be located internally of laser 30 without exceeding the scope. Laser 30 is preferably one of a hand held device, as shown, a truck based device, or airborne device, without limitation.

In stage 1000, an emitted energy beam, such as beam 37 of laser 30, is provided to active fire affected area 10. Laser 30 is located in the vicinity of active fire affected area 10, particular within an effective range of at least one section 45 of scan line 40. In one embodiment laser 30 is a high-powered laser, capable of delivering laser energy to sections 45 with a total fluence of at least 50 micro-joules per square centimeter (50 $\mu J/cm^2$) when measured over a window of 0.1 milliseconds. Preferably, the total fluence is delivered in less than 30 nanoseconds, and further preferably in less than 30 picoseconds to achieve a power of at least 1.67 megawatts per square centimeter (1.6 $MW/cm^2$). In one embodiment the delivered energy beam of laser 30 exhibits a wavelength of less than 300 meters. In another embodiment the delivered energy of laser 30 exhibits a wavelength of less than 30 micro-meters. In one non-limiting embodiment laser 30 is any of: a Fiber laser, a solid-state laser and a laser diode, with the generated light delivered via an appropriate beam delivery system. Preferably, laser 30 is provided as a light weight laser, allowing for hand held use. Further advantageously, laser 30 can be provided as a high efficiency laser, discarding the need for a large and cumbersome power source. Further advantageously, laser 30 can be air cooled, discarding the need for a large and cumbersome cooling source. In one embodiment laser 30 is pulse operated, and in another embodiment laser 30 generates a continuous beam. There is no requirement that the directed energy beam, such as beam 37 be of a single wavelength, and a plurality of wavelengths may be utilized without exceeding the scope.

The term vicinity used herein is defined as any distance close enough to a particular section 45 of scan line 40 to be able to provide the desired laser energy to section 45, as will be described further hereinto below. In one embodiment laser 30 is located at a distance of up to several hundred meters from the particular section 45, in another embodiment laser 30 is located at a distance of less than 100 meters from the particular section 45 and in another embodiment laser 30 is located at a distance of less than 10 meters from the particular section 45; the shorter the distance the less energy is needed. In optional stage 1010, in one embodiment laser 30 is hand held. In another embodiment laser 30 is placed on any of: a robot; a truck; an airborne craft, such as a helicopter, an unmanned aerial vehicle (UAV) and an airplane; a motor-bike; a buggy; and a cross-country motor cycle. In another embodiment, laser 30 is mounted on a paraglider or a sky jumper.

In stage 1020 optical delivery system 35 is operated to scan beam 37 comprising laser energy along scan line 40 with the above mentioned fluence. In one embodiment scan line 40 immediately precedes, and is roughly parallel to, fire front 25. The term immediately preceding, as used herein, is defined as being within a pre-determined estimated time of arrival of fire front 25, preferably more than 1 minute thereof. The laser energy delivered is sufficient such that, in stage 1030, combustible material located in each section 40 of scan line 40 is processed by one of ablation, charring, total oxidation and cutting, thereby creating a firebreak. Cutting leaves and fine branches allows removal of a portion of the cut material from the fire area by natural air flow or gravity. In one embodiment the combustible material, which is primarily in a solid state and is further primarily of cellulose based material, is fast ignited into a fully combustible state, i.e. quickly consumed thereby removing all the fuel in the firebreak. In another embodiment the combustible material is ignited into a partially combustible state and is charred, thereby removing all easily combustible fuel from the firebreak, since charred material has released part of the combustible gases thus reducing the available fuel. In one embodiment each section 45 of scan line 40 is individually scanned with energy from laser 30. In one embodiment the area of each section 45 of scan line 40 is up to 1000 $cm^2$. Such an area is small enough so that provision of the desired energy to each section 45 is possible with a portable light weight laser and yet large enough so as to enable quick and efficient ignition of the combustible material along scan line 40. In one embodiment sections 45 of scan line 40 are circular with a radius of up to 0.5 mm. In another embodiment sections 45 of scan line 40 are rectangular and exhibit an area of up to 1 $mm^2$.

In optional stage 1040, scan line 40 can be extended so as to surround active fire affected area 10. Advantageously, this creates a firebreak surrounding active fire affected area 10, thereby retarding the advancement of fire front 25 even if direction 27 of fire front 25 shifts. Thereafter, fire 20 can be extinguished by any known conventional method, by one or more of the methods described hereinto below, or can be left to burn until it self extinguishes.

Figure 2A:
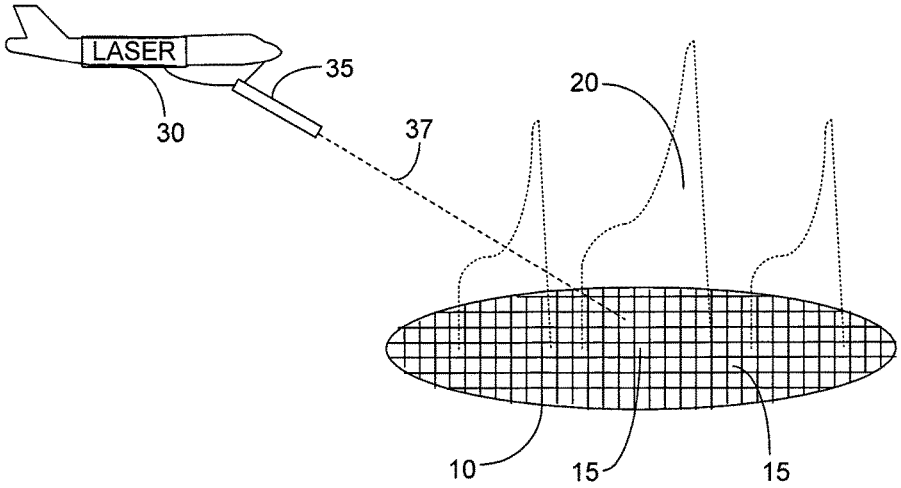
FIG. 2A illustrates a method of emitted energy beam based firefighting, comprising providing energy via an emitted energy beam to an active fire affected area.
Figure 2B:
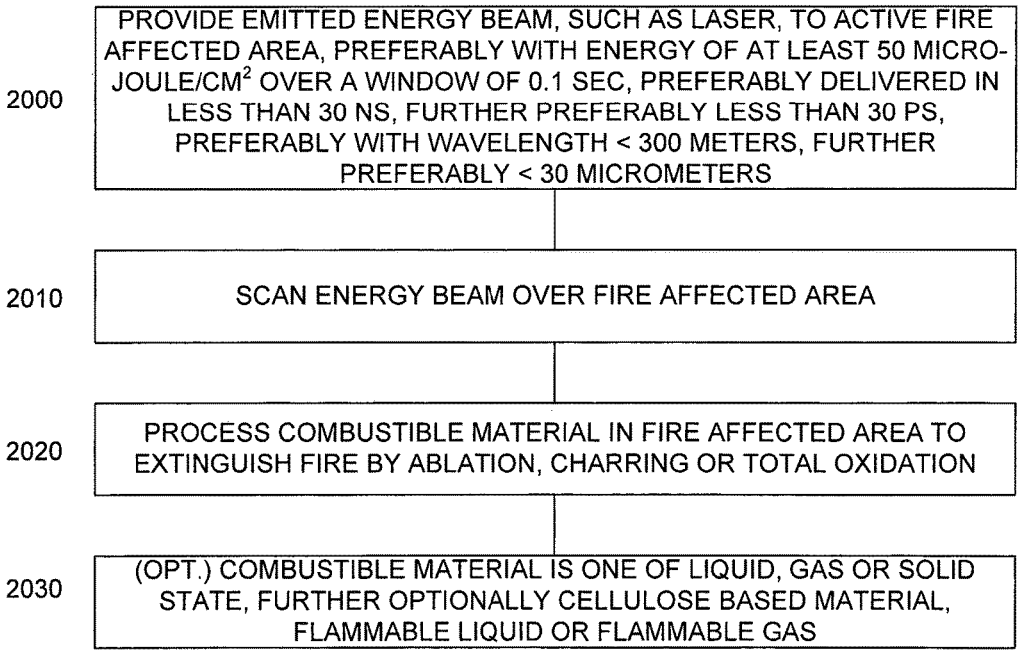
FIG. 2B illustrates a high level flow chart of a first embodiment of the method of FIG. 2A.

FIG. 2A illustrates a method of emitted energy beam based firefighting, comprising providing energy via an emitted energy beam to an active fire affected area and FIG. 2B illustrates a high level flow chart of a first embodiment of the method of FIG. 2A, the figures being taken together. FIG. 2A illustrates active fire affected area 10 which is actively affected by fire 20 and exhibiting sections 15; and laser 30, comprising optical delivery system 35 exhibiting output beam 37, substantially as described above in relation to FIG. 1A. In one embodiment laser 30 is hand held. In another embodiment laser 30 is placed on any of: a robot; a truck; an airborne craft (as shown), such as a helicopter, an unmanned aerial vehicle (UAV) and an airplane; a motor-bike; a buggy; and a cross-country motor cycle. In another embodiment, laser 30 is mounted on a paraglider or a sky jumper. FIG. 2A is being described in relation to a laser, which is a particular example of an emitted energy beam, however this is not meant to be limiting in any way, and the use of a microwave energy beam, particle energy beam, electromagnetic energy beam, plasma beam, or directed induced high voltage electric discharge beam may be used without limitation. Fire affected area 10 is in one embodiment a forest fire, wherein the combustible material mostly comprises cellulose based material. In another embodiment the combustible material in fire affected area 10 is in any of a gas, liquid, or solid state. In one particular embodiment the combustible material in fire affected area 10 comprises a flammable liquid or a flammable gas, which may have accidentally ignited. In one illustrative non-limiting example, the flammable liquid may be crude oil. In another illustrative non-limiting example, the flammable gas may be natural gas.

In stage 2000, an emitted energy beam, such as beam 37 of laser 30, is provided to active fire affected area 10, as described above in relation to FIGS. 1A-1B. In one embodiment the fluence of the delivered laser energy, measured at active fire affected area 10, exhibits a total fluence of at least 50 tJ/cm$^2$ when measured over a window of 0.1 milliseconds. Preferably, the total fluence is delivered in less than 30 nanoseconds, and further preferably in less than 30 picoseconds. In one embodiment the delivered laser energy of laser 30 exhibits a wavelength of less than 300 meters. In another embodiment the delivered laser energy of laser 30 exhibits a wavelength of less than 30 micro-meters. In stage 2010 optical delivery system 35 is operated to scan beam 37 comprising laser energy over active fire affected area 10 with the above mentioned fluence. The energy beam delivered is sufficient such that, in stage 2020, combustible material located in active fire affected area 10 is consumed, i.e. processed by one of ablation, charring, total oxidation and cutting. Cutting leaves and fine branches allows removal of a portion of the cut material from the fire area by natural air flow or gravity. As a result the fuel in active fire affected area 10, i.e. foliage, branches, etc. is rapidly consumed, thereby starving fire 20. In one embodiment each section 15 of active fire affected area 10 is individually scanned with laser energy from laser 30. In one embodiment the area of each section 15 is up to 1000 cm$^2$. Such an area is small enough so that provision of the desired energy of beam 37 to each section 15 is possible with a portable light weight laser and yet large enough so as to enable quick and efficient ignition of the combustible material in active fire affected area 10.

In stage 2030, and as indicated above, the various embodiments are not limited to a forest fire wherein the combustible material is primarily cellulose based material. Optionally, the combustible material may be in any of a gas, liquid, or solid state. In one particular embodiment the combustible material in fire affected area 10 comprises a flammable liquid or a flammable gas, which may have accidentally ignited. In one illustrative non-limiting example, the flammable liquid may be crude oil. In another illustrative non-limiting example, the flammable gas may be natural gas. There is no requirement that the combustible material be uniform, and various sections 15 may comprise different combustible materials without exceeding the scope. In one particular non-limiting embodiment, sections 15 of active fire affected area 10 represent the fire front.

There is no requirement that the directed energy beam, such as the beam 37 be of a single wavelength, and a plurality of wavelengths may be utilized without exceeding the scope.

Figure 2C:
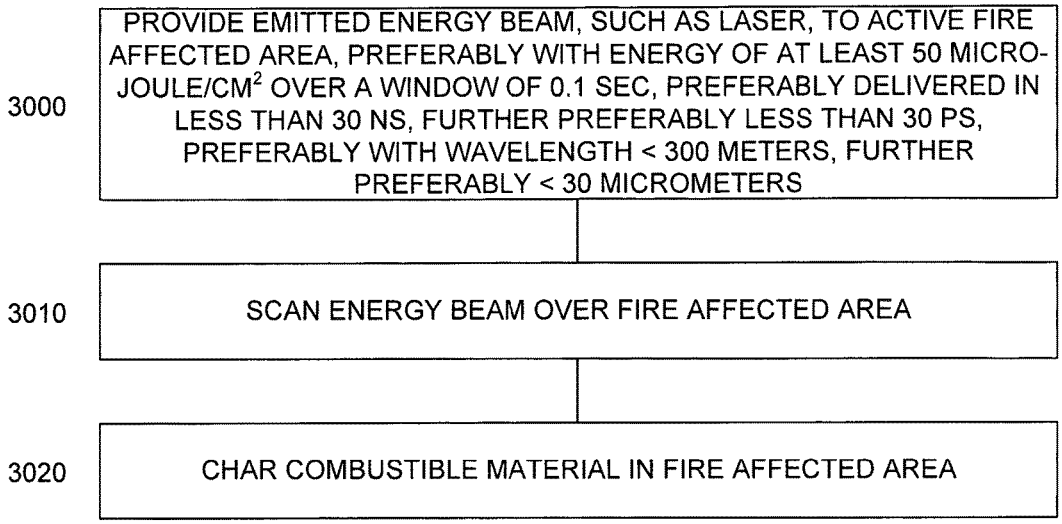
FIG. 2C illustrates a high level flow chart of a second embodiment of the method of FIG. 2A.

FIG. 2C illustrates a high level flow chart of a second embodiment of the method of FIG. 2A, the figures being taken together. FIG. 2A is being described in relation to a laser, which is a particular example of an emitted energy beam, however this is not meant to be limiting in any way, and the use of a microwave energy beam, particle energy beam, electromagnetic energy beam, plasma beam, or directed induced high voltage electric discharge beam may be used without limitation. In stage 3000, an emitted energy beam, such as beam 37 of laser 30, is provided to active fire affected area 10, as described above in relation to FIGS. 1A-1B. In one embodiment the fluence of the delivered energy, measured at active fire affected area 10, is at least 50 μJ/cm$^2$ when measured over a window of 0.1 milliseconds. Preferably, the total fluence is delivered in less than 30 nanoseconds, and further preferably in less than 30 picoseconds. In one embodiment the delivered energy of laser 30 exhibits a wavelength of less than 300 meters. In another embodiment the delivered energy of laser 30 exhibits a wavelength of less than 30 micro-meters. In stage 3010, optical delivery system 35 is operated to scan beam 37 comprising laser energy over active fire affected area 10 with the above mentioned fluence. The laser energy delivered is sufficient such that, in stage 3020, combustible material located in fire affected area 10 is charred. Charred material has released part of the combustible gases thus reducing the available fuel and therefore the advancement of fire 20 is retarded.

In one embodiment each section 15 of active fire affected area 10 is individually scanned with laser energy from laser 30. In one embodiment the area of each section 15 is up to 1000 cm$^2$. The beam size is preferably selected so as to minimize the affected area and control the laser processing rate responsive to the available laser energy. Such an area is small enough so that provision of the desired energy of beam 37 to each section 15 is possible with a portable light weight laser and yet large enough so as to enable quick and efficient charring of the combustible material in active fire affected area 10.

Figure 3A:
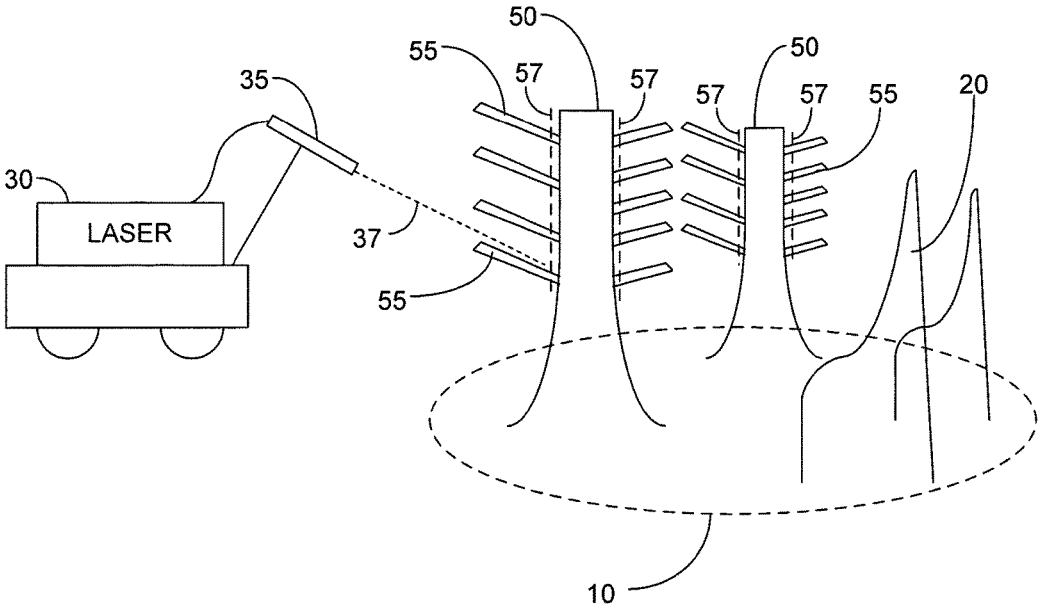
FIG. 3A illustrates a method of emitted energy beam based firefighting, comprising processing horizontal growths.
Figure 3B:
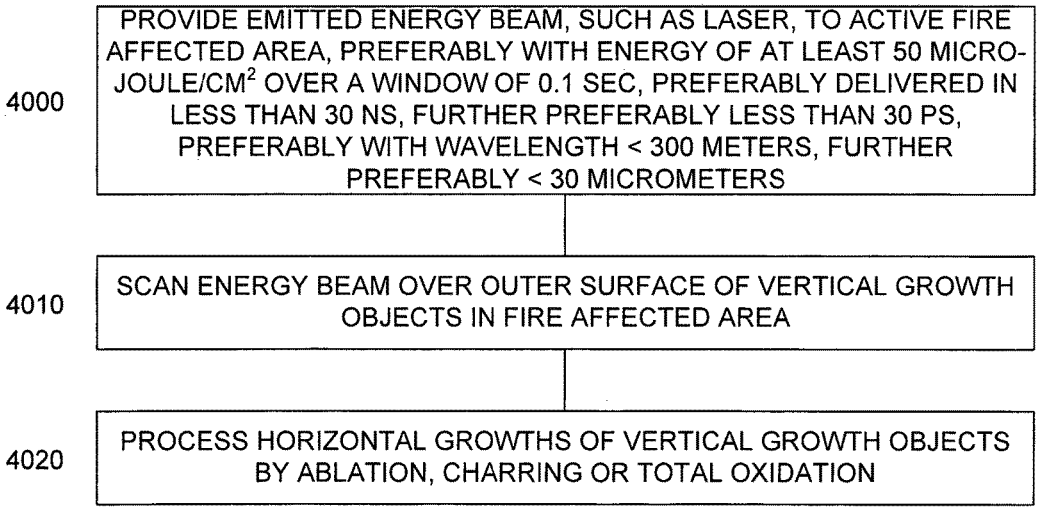
FIG. 3B illustrates a high level flow chart of the method of FIG. 3A.

FIG. 3A illustrates a method of emitted energy beam based firefighting, comprising processing horizontal growths by one of ablation, charring, or total oxidation, and FIG. 3B illustrates a high level flow chart of the method of FIG. 3A, the figures being taken together. FIGS. 3A-3B are being described in relation to a laser, which is a particular example of an emitted energy beam, however this is not meant to be limiting in any way, and the use of a microwave energy beam, particle energy beam, electromagnetic energy beam, plasma beam, or directed induced high voltage electric discharge beam may be used without limitation. FIG. 3A illustrates active fire affected area 10 affected by fire 20; and laser 30, comprising optical delivery system 35 exhibiting output beam 37, substantially as described above in relation to FIG. 1A and producing a plurality of processing lines 57, as will be described further below. There is no requirement that the directed energy beam, such as beam 37 be of a single wavelength, and a plurality of wavelengths may be utilized without exceeding the scope.

In one embodiment laser 30 is hand held. In another embodiment laser 30 is placed on any of: a robot; a truck (as shown); an airborne craft, such as a helicopter, an unmanned aerial vehicle (UAV) and an airplane; a motor-bike; a buggy; and a cross-country motor cycle. In another embodiment, laser 30 is mounted on a paraglider or a sky jumper. A plurality of vertical growth objects 50, each exhibiting a plurality of horizontal growths 55, are located in active fire affected area 10. Vertical growth objects 50 can be any of trees and bushes, without limitation and are illustrated as trees. Horizontal growths 55 of vertical growth objects 50 are, in one non-limiting example, branches and are illustrated as such. The term vertical growth objects is not meant to be limiting to objects growing precisely vertically and is specifically meant to include any object growing out from the ground, at any angle in relation to the ground. The term horizontal growths is not meant to be limiting to growths growing precisely horizontally and is specifically meant to include any growth growing out from a vertical growth object, at any angle in relation to the growth angle of the respective vertical growth object and any growth growing out from another horizontal growth.

In stage 4000, an emitted energy beam, such as beam 37 of laser 30, is provided to active fire affected area 10, as described above in relation to FIGS. 1A-1B. In one embodiment the fluence of the delivered laser energy, measured at fire affected area 10, is at least 50 $\mu J/cm^2$ when measured over a window of 0.1 milliseconds. Preferably, the total fluence is delivered in less than 30 nanoseconds, and further preferably in less than 30 picoseconds. In, one embodiment the delivered laser energy of laser 30 exhibits a wavelength of less than 300 meters. In another embodiment the delivered laser energy of laser 30 exhibits a wavelength of less than 30 micro-meters. In stage 4010, optical delivery system 35 is operated to scan beam 37 comprising energy over the outer surface of each of vertical growth objects 50 with the above mentioned fluence. The energy delivered is sufficient such that, in stage 4020, the horizontal growths 55 of the respective vertical growth object 50 are processed by one of ablation, charring, total oxidation and cutting at respective processing lines 57. Specifically, and utilizing a tree as a non-limiting example of a vertical growth object having branches as a non-limiting example of horizontal growth objects extending there from, energy is delivered to each branch 55 of each tree 50 along processing line 57, thereby removing from, and/or charring branches 55 of trees 50. As a result fire 20 will only have fuel on the ground of fire affected area 10, as the ignition of a bare thick tree trunk takes much longer and requires a higher temperature than a branch filled tree. Furthermore, cutting leaves and fine branches allows removal of a portion of the cut material from the fire area by natural air flow or gravity. The advance of fire 20 is thus retarded and fire 20 can then be extinguished by any conventional method or by any of the above mentioned methods. Additionally, the removed horizontal growths which descend towards the ground level of active fire affected 10 may exhibit a certain amount of char as a result of the delivered energy, thereby assisting in the retardation of the advance of fire 20 and the extinguishing thereof.

There is no requirement that all branches 55 be removed from the respective tree 50 and a plurality of branches 55, specifically very thick branches may be left on the respective tree 50, without exceeding the scope. In another embodiment only fine branches and leaves are processed. In yet another embodiment only fine branches and leaves below a predetermined height above the ground are processed, thereby preventing advance of the fire.

Furthermore, there is no requirement that the outer surfaces of all trees 50 located within fire affected area 10 be scanned with laser energy and trees 50 which do not significantly aid fire 20 can be left untouched, without exceeding the scope.

The above has been described in relation to extinguishing forest, bush, field and brush fires with an emitted energy beam, however this is not meant to be limiting in any way. Energy from an emitted energy beam may be similarly used to extinguish any fire without limitation, particularly including fuel or other combustible spills.

The energy levels indicated above are sufficient to fast accomplish the above mentioned extinguishing. In one non-limiting example, calculation of the energy required to fast burn or cut a dry leaf blade is herein described. Consider a dry leaf with a 0.1 mm thickness and 5% water content by weight. The energy required to cut this leaf by fast combustion of the leaf materials is 0.069 J/patch. This is derived by calculating the energy required to heat the leaf material to the typical ignition temperature of cellulose containing material, i.e. 450 deg C. The above energy includes the typical Cp=2.3 J/g/K, wherein Cp water=4.186 J/g/K, dT=430 K, dT water=200 K, and water vaporization heat (Vph)=2260 J/g, density(d)=0.6 g/cm^3, beam patch=beam size on leaf=1×1 mm=1 mm^2.

This data set is well within the range of the well documented and published experimental data although there exists a large data range and variation in the experimental results, data sets and experimental procedures. To enable extinguishing, we calculate the process energy needed to burn a hole through the leaf. We first calculate the leaf beam size processed volume: Volume=1 mm^2*0.1 mm=0.1 mm^3. The energy required is:

$$Qe[J]=Cp*dT*\text{Volume}*d+Cp\ \text{water}*dT\ \text{water}*d*5\%+Vph*d*5\%=0.069J$$

This is for one beam size hole through the leaf. This leaf hole may be performed by a single pulse of an energy beam on the leaf or by multiple smaller pulses of energy adding up to the total energy needed to cut through and/or burn-fast the leaf material to detach/consume the tree/bush/grass, while ensuring that multiple pulses are delivered fast enough so as to process/incinerate/cut off the leaf blade. The energy needed to process the vegetation may be provided in one embodiment using a pulsed laser beam with 50 uJ/cm^2 on the leaf. This leads to a 0.5 uJ/mm^2 for each beam of 1 mm^2 on the leaf. Since in this example the leaf requires 0.069 J/mm^2 for processing, this requires 1.38e5 pulses of this beam to complete the process.

Utilizing an exemplary non-limiting example of a 160 MHz pulsed laser beam of 50 uJ/cm^2 per pulse of energy on the leaf results in a processed linear speed of nearly 1.16 m/s.

The energy needed to process vegetation of a section of a green pine needle with a dimension of 1×1×0.5 mm=0.5 mm^3 volume is now further explored. The green needle exhibits a typical 70% water content in the dry period. Energy of 0.95 Joule is needed to heat the green pine needle segment to completely incinerate/burn at a temperature of 450 deg Celsius, based primarily on heating the water and the cellulose content thereof.

Thus, an energy beam of 95 J/cm^2 is required to be projected on a 1×1 mm target to accomplish the above. This may be provided by a single pulse of energy or multiple pulses of energy summing up to this value, provided that the energy is delivered fast enough to process/incinerate/cut off the needle/leaf blade of the target. In order for a beam to advance at a linear velocity of 1 m/s, 1000 pulses of energy per second of an energy beam of 950 w is to be supplied, which is available from commercial high energy lasers.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described herein above. Rather the scope of the present invention is defined by the appended claims and includes both combinations and sub-combinations of the various features described hereinabove as well as variations and modifications thereof which would occur to persons skilled in the art upon reading the foregoing description and which are not in the prior art.

I claim:

1. A method of fire fighting, the method comprising:

providing energy via an emitted pulsed energy beam to an active fire affected area;

directing said emitted pulsed energy beam to combustible fine fuel within the active fire affected area, wherein said emitted pulsed energy beam ablates the combustible fine fuel within the active fire affected area, said provided energy sufficient to rapidly process the combustible fine fuel by said ablation such that the active fire is starved of the combustible fine fuel, wherein said provided energy exhibits a power of at least 1.67 mega-watts per square centimeter at the combustible fine fuel.

2. The method of claim 1, wherein said provided energy exhibits a total fluence of at least 50 micro-joules per square centimeter delivered over a window of less than 30 pico-seconds, when measured at the combustible fine fuel.

3. The method of claim 1, wherein said emitted pulsed energy beam is directed such that said ablation of the fine fuel within the active fire affected area creates a firebreak.

4. The method of claim 3, wherein said firebreak is created along a path immediately preceding, and roughly parallel with, an advancing front of the active fire such that said firebreak is created at least 1 minute before the arrival of the active fire advancing front.

5. The method of claim 1, wherein said emitted pulsed energy beam is directed at combustible fine fuel horizontal growths protruding from the outer surface of vertical growth objects.

6. The method of claim 1, wherein the provided energy exhibits a wavelength of up to 300 meters.

7. The method of claim 1, wherein the provided energy exhibits a wavelength of up to 30 micro-meters.

8. The method of claim 1, wherein the fine fuel consists of fuels which exhibit a diameter of less than 0.25 inches.

9. The method of claim 1, wherein said emitted pulsed energy beam is provided over a distance of at least 200 meters.

10. The method of claim 1, wherein said emitted energy pulse is directed at combustible fine fuel which is located at a distance from an advancing front of the active fire great enough such that it will take more than 1 minute for the active fire advancing front to reach the combustible fine fuel.

11. The method of claim 8, wherein said emitted pulsed energy beam is directed such that said ablation of the fine fuel within the active fire affected area creates a firebreak.

12. The method of claim 11, wherein said firebreak is created along a path immediately preceding, and roughly parallel with, an advancing front of the active fire such that said firebreak is created at least 1 minute before the arrival of the active fire advancing front.

13. The method of claim 8, wherein said emitted pulsed energy beam is directed at combustible fine fuel horizontal growths protruding from the outer surface of vertical growth objects.

14. The method of claim 8, wherein said emitted energy pulse is directed at combustible fine fuel which is located at a distance from an advancing front of the active fire great enough such that it will take more than 1 minute for the active fire advancing front to reach the combustible fine fuel.

* * * * *